United States Patent [19]

Linstromberg

[11] Patent Number: 4,754,615

[45] Date of Patent: Jul. 5, 1988

[54] ICE MAKER HEAT SHIELD AND MOUNT FOR PLASTIC LINER REFRIGERATOR SUPPORT

[75] Inventor: William J. Linstromberg, St. Joseph, Mich.

[73] Assignee: Whirlpool Corporation, Benton Harbor, Mich.

[21] Appl. No.: 83,448

[22] Filed: Aug. 10, 1987

[51] Int. Cl.[4] ..... F25C 1/24

[52] U.S. Cl. ..... 62/300; 62/465

[58] Field of Search ..... 62/300, 465; 248/250, 248/220.2; 312/245, 242

[56] References Cited

U.S. PATENT DOCUMENTS

| | | | |
|---|---|---|---|
| 2,450,722 | 10/1948 | Drije | 312/245 X |
| 2,717,504 | 9/1954 | Knerr | 62/137 |
| 2,837,900 | 6/1958 | Harle | 62/465 X |
| 3,827,775 | 8/1974 | Arrogante | 312/245 |
| 3,832,863 | 9/1974 | Boorman Jr. | 62/300 X |
| 4,190,305 | 2/1980 | Knight et al. | 312/214 |
| 4,464,256 | 8/1984 | Wolbrink et al. | 248/544 |
| 4,620,476 | 11/1986 | Brym | 312/245 X |

FOREIGN PATENT DOCUMENTS

| | | | |
|---|---|---|---|
| 129626 | 1/1985 | European Pat. Off. | 312/245 |
| 821410 | 10/1957 | United Kingdom | 312/245 |
| 2155310 | 9/1985 | United Kingdom | 312/245 |

*Primary Examiner*—William E. Tapolcai

*Attorney, Agent, or Firm*—Wood, Dalton, Phillips, Mason & Rowe

[57] ABSTRACT

According to the invention, a support/heat shield is provided for mounting an ice maker from the plastic liner on the inside of a refrigeration apparatus. The invention contemplates mounting the support/heat shield on the liner at the juncture of a first, horizontal wall, and a second vertical wall, depending from the first wall. The support/heat shield, in its simplest state, has third and fourth flat walls, at right angles to each other, with wall surfaces for situation facially against the first and second liner walls. The fourth wall is attached to the first liner wall and the third wall to the second liner wall. The icemaker is attached to the third wall of the support/heat shield.

16 Claims, 1 Drawing Sheet

FIG. 1
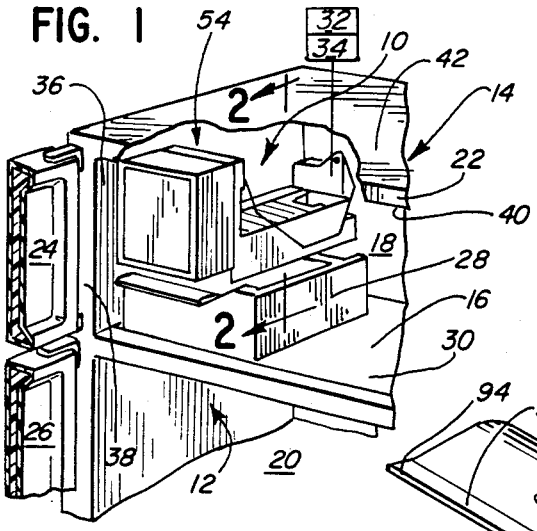
FIG. 4
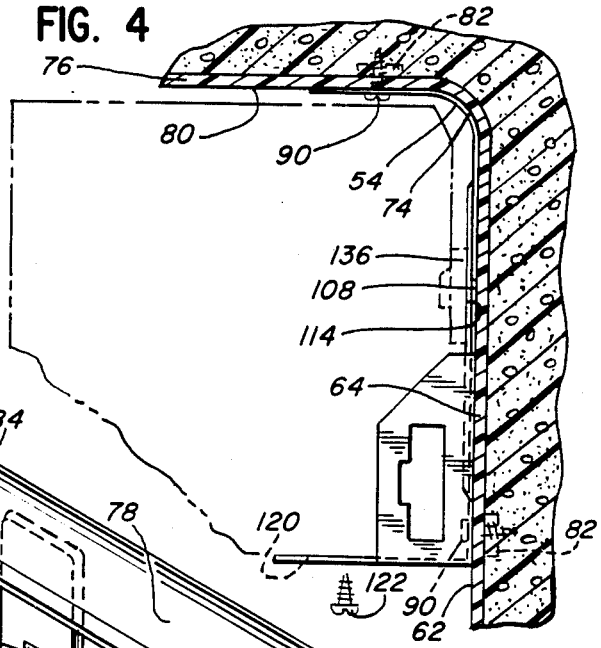
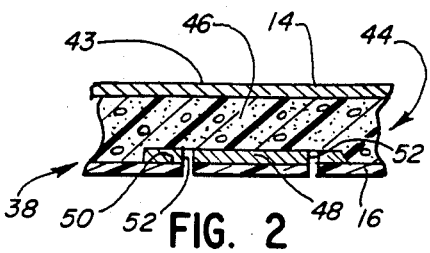
FIG. 2
PRIOR ART
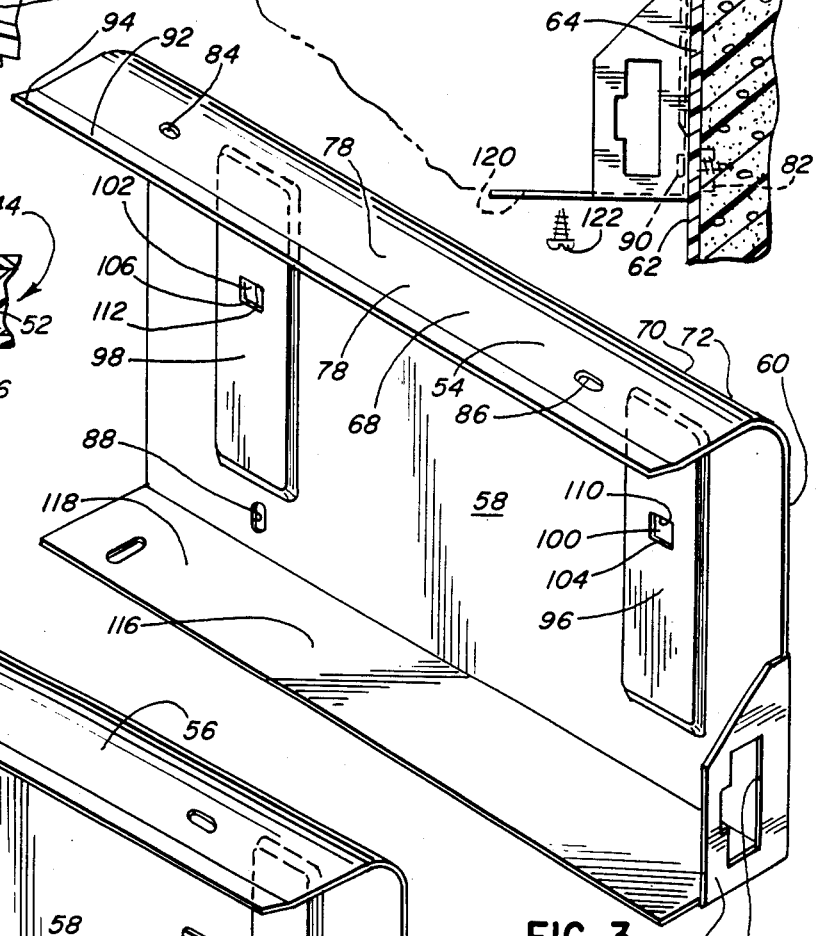
FIG. 3
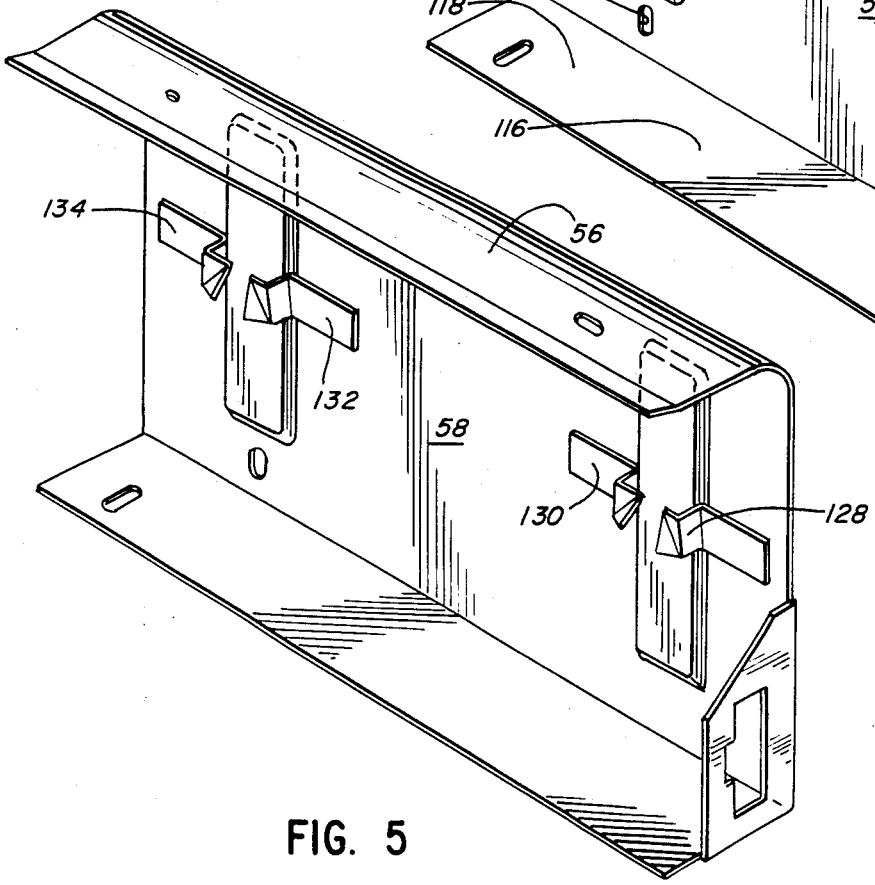
FIG. 5

ICE MAKER HEAT SHIELD AND MOUNT FOR PLASTIC LINER REFRIGERATOR SUPPORT

BACKGROUND OF THE INVENTION

1. Field of the Invention

This invention relates to refrigeration apparatus and, more particularly, to a support structure for an icemaker within the refrigerator apparatus.

2. Background Art

Manufacturers of refrigeration apparatus generally build structure for mounting an icemaker into each cabinet. Separate kits can be sold to those consumers opting for an icemaker, which is attached utilizing the built-in mounting structure. If an icemaker is not desired, the mounting structure nonetheless remains a permanent part of the cabinet. Because only a small percentage of refrigeration apparatus ultimately have icemakers installed, it is desirable to minimize the cost of manufacturing and installing the icemaker mounting structure.

In most refrigeration apparatus, a plastic liner bounds the refrigerated storage space. The plastic sheet material of the liner is thin, flexible and somewhat brittle and, by itself, provides an inadequate support for an icemaker. It is conventional to provide a steel plate on the back of the liner and to hold the plate in place by the disposition of a foam insulating material over the plate in the space between the liner and an external sheet metal covering. The plate reinforces the liner and distributes potentially damaging forces over a large area of the liner surface.

The use of a reinforcing steel plate has numerous drawbacks. The plate is relatively expensive, as it is generally sufficiently large to span substantially the entire area of the icemaker wall that is placed against the liner. From a manufacturing standpoint, maintaining the plate in proper position as it is fixed in place by the foam filler is a relatively delicate operation.

with the conventional construction, a separate metal shield must additionally be provided between the icemaker and plastic liner. Underwriters Laboratories requires the provision of such a heat shield to prevent exposure of the flammable plastic liner to electric wiring, which is part of the icemaker.

SUMMARY OF THE INVENTION

The present invention is specifically directed to overcoming the above enumerated problems in a novel and simple manner.

According to the invention, a support/heat shield is provided for mounting an ice maker from the plastic liner on the inside of a refrigeration apparatus. The invention contemplates mounting the support/heat shield on the liner at the juncture of a first, horizontal wall, and a second vertical wall, depending from the first wall. The support/heat shield, in its simplest state, has third and fourth flat walls, at right angles to each other, with wall surfaces for situation facially against the first and second liner walls. The fourth wall is attached to the first liner wall and the third wall to the second liner wall. The icemaker is attached to the third wall of the support/heat shield.

Whereas with a conventional icemaker mount on a vertical wall of a liner there is a substantial force tending to draw the icemaker away from the vertical liner wall, this force is substantially diminished by the inventive support/heat shield. Forces from the weight of the icemaker tending to draw the third wall away from the second wall are resisted by the fourth wall which is fixedly connected to the first liner wall. Accordingly, the large reinforcing plate in conventional structures can be eliminated and very small nut anchors plate can be installed on the back wall of the liner in its stead. The effect of the connection of the fourth wall to the first wall is to cause the principal forces from the weight of the icemaker to be directed vertically downwardly on the liner, in which direction the liner is the strongest.

The invention contemplates that the support/heat shield be made from sheet metal which defines a barrier between the icemaker and liner. The support/heat shield thus serves the dual purpose of supporting the icemaker and acting as a shield for the liner from the heat of the icemaker, as industry standards require.

Preferably, the support/heat shield is formed from a single blank of sheet metal material and bent in the shape of a U. The fourth wall defines one leg of the U and a fifth wall beneath the fourth wall defines the other leg of the U and a surface against which the icemaker bears and to which the icemaker is secured.

The support/heat shield is rigidified according to the invention in two different ways. First, a reinforcing wall extends between the third and fifth walls and has an opening to permit passage therethrough of wiring for the ice maker. Additionally, a portion of the third wall is impressed to be offset from the plane of the third wall. This rigidifies the third wall and at the same time provides a space between the impression and the liner for the placement of mounting clips to attach the icemaker to the third support/heat shield wall.

As an alternative to the use of a separate clip in the space defined by the impressed portion of the third wall, integral clips can be bent out of the third wall to accomplish the same end.

to rigidify the connection of the support/heat shield to the liner, the fourth wall has an upwardly offset lip defining a free edge which bears on the first liner surface. As the fourth wall is drawn upwardly during assembly, the lip in effect digs into and is drawn tightly against the first liner wall and assures that a substantial contact area is established between the support/heat shield and the first wall of the liner.

BRIEF DESCRIPTION OF THE DRAWINGS

FIG. 1 is a fragmentary, perspective view of a refrigeration apparatus with an icemaker mounted therein through use of a support/heat shield according to the invention;

FIG. 2 is a cross-sectional view of a prior art reinforcing plate used to support an icemaker from a vertical wall of a refrigeration apparatus;

FIG. 3 is a perspective view of the support/heat shield;

FIG. 4 is a sectional view of the assembled support/heat shield taken along line 2—2 of FIG. 1; and FIG. 5 is a perspective view of a modified form of support/heat shield according to the present invention.

DESCRIPTION OF THE PREFERRED EMBODIMENTS

In FIG. 1, an icemaker at 10 is shown incorporated into a conventional type refrigeration apparatus at 12. The refrigeration apparatus 12 consists of a square cabinet 14 with an internal, plastic liner 16 bounding a freezing compartment 18 and a separate, refrigerated compartment 20. The cabinet 14 has a front wall 22 that is open to permit access to both compartments 18, 20. The freezing compartment 18 is selectively sealed by a hinged door 24 and, therebeneath, the compartment 20 is sealed selectively by a hinged door 26, in like fashion.

The icemaker 10 is of a conventional construction. Cubed ice is delivered from the icemaker 10 into a storage bin 28 supported on a shelf 30 between the compartments 18, 20. The icemaker 10 receives water from a supply, shown schematically at 32, and electric power from a source, shown schematically at 34.

To optimize space utilization, the icemaker 10 is situated in the compartment 18 preferably closely adjacent both the laterally facing surface 36 of the cabinet side wall 38 and the downwardly facing surface 40 on the upper cabinet wall 42.

A conventional mounting structure that is normally permanently incorporated into a refrigeration cabinet is shown in FIG. 2. The cabinet 14 is defined by an external sheet metal shell 43 which surrounds the liner 16, so as to leave a space 44 between the shell 43 and liner 16. Foam 46 is sprayed between the shell 43 and liner 16 and fills the space 44 to insulate the compartments 18, 20 from the atmosphere and rigidify both the shell 43 and liner 16. In the prior art structure of FIG. 2, a flat, rectangular, steel plate 48 is placed facially against the outwardly facing surface 50 of the liner 16. The plate 48 is held in place by tape and the foam insulation 46. The plate 48 has apertures 52 to facilitate passage of bolts (not shown) for mounting the icemaker 10. The plate 48 affords a firm foundation for the icemaker 10 and distributes loading forces from the icemaker 10 over a substantial area of the liner surface 50.

According to the invention, a support/heat shield 54, in FIGS. 1, 3 and 4, and 56, in FIG. 5, is provided and obviates the need for a large reinforcing plate as shown in the prior art structure in FIG. 2. Referring initially to the embodiment in FIGS. 1, 3 and 4, the support/heat shield 54 is generally U-shaped and preferably formed from a single blank of sheet metal material. The support/heat shield 54 consists of a flat wall 58 at the base of the U with a flat surface 60 arranged to be placed facially against a flat surface 62 on the vertical liner wall 64. At the upper portion of the wall 58, the support/heat shield 54 is folded back to define a wall 68, making up one of the legs of the U and disposed substantially perpendicular to the wall 58. The support/heat shield 54 has a curved corner 70 joining between the walls 58, 68. A convex surface 72 on the corner 70 is substantially matched to the curvature of the corner 74 on the liner 16 between the vertical wall 64 thereof and the top wall 76 of the liner 16 bounding the compartment 18. The wall 68 of the support/heat shield 54 has an upwardly facing surface 78. With the surface 72 nested in the liner corner 74, the support/heat shield surfaces 60, 78 are presented facially against the liner surfaces 62, 80 respectively.

Anchor nuts 82 are held in place on the back surface 50 of the liner 16 in alignment with apertures 84, 86 in the wall 68 and aperture 88 in the wall 58 on the support/heat shield 54. Screws 90 are directed into the anchor nuts 82 to hold the walls 58, 68 fixedly against the liner walls 64, 76, respectively. The apertures 86, 88 are elongated to accommodate inaccurate positioning of the anchor nuts 82 on the liner 16.

The wall 68 has an upturned lip 92 at its free end. As the wall 68 is drawn tightly against the liner 16 through the screws 90, the corner edge 94 on the lip 92 tends to dig into the liner 16 to positively hold the position of the support/heat shield 54 on the liner 16. The inclusion of the lip 92 also assures that substantially the entire length of the wall 68 is brought into contact with the liner 16.

The wall 58 has two rectangular impressions 96, 98 made therein. The impressions 96, 98 serve the dual purpose of rigidifying the wall 58 and affording spaces 100, 102, respectively between the outwardly impressed wall surface 104, 106 and the liner surface 62. The spaces 100, 102 accommodate mounting clips 108, which are passed through apertures 110, 112 in the impressions 96, 98 and supported thereby. The clips 108 cooperatively support a vertical wall 114 on the icemaker 10.

Further support is provided for the icemaker 10 by a wall 116, integrally formed with the wall 58 and extending outwardly therefrom at substantially a right angle. The wall 116 has an upwardly facing surface 118 which bears on the underside 120 of the icemaker 10. A screw 122 secures the wall 116 to the icemaker 10.

A reinforcing wall 124 connects between the walls 58, 116. The reinforcing wall 124 has an aperture 126 configured to allow passage of an electrical supply 34 to the icemaker 10.

As described, the support/heat shield 54 supports the icemaker 10 at three different locations—supported on the clips 108 on the impressions 96, 98 and on the wall 116. The icemaker 10 is not directly connected to the upper wall 68 of the support/heat shield 54. Forces exerted due to the weight of the icemaker 10 tending to draw the wall 58 away from the liner 16 are resisted by the wall 68 connected to the upper wall 76 of the liner 16. Thus, the direction of force transmission from the weight of the icemaker 10 to the vertical liner wall 64 is substantially vertical, in which direction the liner has maximum strength.

At the same time, the support/heat shield 54 is made sufficiently large that it will shield the liner wall 64 from direct exposure to the ice maker 10. The support/heat shield 54 serves the dual purpose of supporting the icemaker 10 and satisfied UL requirements for shielding.

In FIG. 5, a modified form of support/heat shield 56 is shown. The support/heat shield 56 is substantially the same as that structure in FIGS. 1, 3 and 4, with the exception that separate clips 108 are not required as in the prior embodiment. Rather, straps 128, 130, 132, 134 are formed from wall 58 and cooperatively define seats for mounting elements 136 on the icemaker 10. In all other respects, the structure 56 operates like that in the previously described embodiment.

I claim:

1. A support for an icemaker in a refrigeration apparatus having a cabinet with a flexible liner defining a storage space and having a first wall with a downwardly facing flat surface and a second wall with a vertically extending flat surface, said support comprising:

a third wall;

a fourth wall connected to and angularly oriented with respect to the third wall;

means for attaching the third wall to the flat surface of the second liner wall;

means for attaching the fourth wall to the downwardly facing surface of the first liner wall; and means for attaching an icemaker to the third wall so that forces due to the weight of an icemaker tending to draw the third wall away from the second liner wall are resisted by the fourth wall which is attached to the first liner wall.

2. The icemaker support according to claim 1 wherein said support is made from metal.

3. The icemaker support according to claim 1 wherein said support is formed from a single blank of sheet metal.

4. The icemaker support according to claim 1 wherein said support has a fifth wall having a upwardly facing surface and means are provided to attach the upwardly facing surface of the fifth wall to an icemaker to be carried on the support.

5. The icemaker support according to claim 1 wherein said support has a flat fifth wall making approximately a right angle with the third wall surface, a reinforcing wall connects between the fifth wall and the third wall and has an opening to permit passage therethrough of an electrical supply line for an icemaker and means are provided to attach the fifth wall to an icemaker to be carried on the support.

6. The icemaker support according to claim 1 wherein said fourth wall has a free edge and an upwardly turned lip at the free edge which lip bears on the first liner wall to secure attachment of the fourth wall to the first wall.

7. The icemaker support according to claim 1 wherein said support has integrally formed clips on the third wall to facilitate mounting of an icemaker.

8. The icemaker support according to claim 1 wherein said third wall has an integral impression to reinforce the third wall and define a space between an offset wall on the impression and the second wall for the situation of a mounting clip for an icemaker.

9. An icemaker support for use in a refrigeration apparatus of the type having a plastic liner with first and second walls defining respectively first and second flat surfaces arranged substantially at right angles to each other with the first surface facing downwardly and the second surface extending substantially vertically below said first surface, said support comprising:

a third flat wall having a third flat surface for situation facially against said second surface;

a fourth flat wall integrally formed with the third flat wall and having a fourth flat surface substantially perpendicular to the third surface for situation facially against the first flat surface;

means for securing the third flat wall to the second flat wall to maintain the second and third surfaces facially against each other;

means for securing the fourth wall to the first wall to maintain the first and fourth surfaces facially against each other; and means for attaching an icemaker to the third wall so that forces due to the weight of an icemaker tending to draw the third wall away from the second wall are resisted by the fourth wall which is attached to the first wall.

10. The icemaker support according to claim 9 wherein said support is made from metal.

11. The icemaker support according to claim 9 wherein said support is formed from a single blank of sheet metal.

12. The icemaker support according to claim 9 wherein said support has a fifth wall having an upwardly facing surface and means are provided to attach the upwardly facing surface of the fifth wall to an icemaker to be carried on the support.

13. The icemaker support according to claim 9 wherein said support has a flat fifth wall making approximately a right angle with the third wall surface, a reinforcing wall connects between the fifth wall and the third wall and has an opening to permit passage therethrough of an electrical supply line for an icemaker and means are provided to attach the fifth wall to an icemaker to be carried on the support.

14. The icemaker support according to claim 9 wherein said fourth wall has a free edge and an upwardly turned lip at the free edge which lip bears on the first liner wall to secure attachment of the fourth wall to the first wall.

15. The icemaker support according to claim 9 wherein said support has integrally formed clips on the third wall to facilitate mounting of an icemaker.

16. The icemaker support according to claim 9 wherein said third wall has an integral impression to reinforce the third wall and define a space between an offset wall on the impression and the second wall for the situation of a mounting clip for an icemaker.

* * * * *